US006536418B1

(12) United States Patent
Ling

(10) Patent No.: US 6,536,418 B1
(45) Date of Patent: Mar. 25, 2003

(54) COMBUSTION ENHANCEMENT DEVICE FOR INTERNAL COMBUSTION ENGINES

(76) Inventor: Yuan-Hung Ling, No. 20, Lane 295, Hwan East Rd., Yang Mei City, Taoyuan (TW)

( * ) Notice: Subject to any disclaimer, the term of this patent is extended or adjusted under 35 U.S.C. 154(b) by 0 days.

(21) Appl. No.: 10/091,517

(22) Filed: Mar. 7, 2002

(51) Int. Cl.[7] ..... F02M 33/00
(52) U.S. Cl. ..... 123/539
(58) Field of Search ..... 123/539, 536

(56) References Cited

U.S. PATENT DOCUMENTS 5,010,869 A * 4/1991 Lee ..... 123/539
5,487,874 A * 1/1996 Gibboney, Jr. ..... 123/539
6,176,977 B1 * 1/2001 Tayleor et al. ..... 123/539

* cited by examiner

*Primary Examiner*—Marguerite McMahon
(74) *Attorney, Agent, or Firm*—Rosenberg, Klein & Lee

(57) ABSTRACT

A combustion enhancement device for internal combustion engines installed in front of the carburetor (or fuel injection pump) comprised of tourmaline crystal or mildly radioactive tritium isotope mineral elements. The tourmaline is directly utilized for the operation of a negatively charged ion generator that provides large volumes of negatively charged ions such that when air containing oxygen induced into the carburetor and the combustion chamber is thereby combustion-enhanced, a large volume of negatively charged ions is mixed with the large volume of positively charged particles naturally present in the air, enhancing combustion by purifying the oxygen required. As such, the power creating combustion of an internal combustion engine not only occurs at greater efficiency, but fuel is also combusted more completely, energy is saved because less fuel is required for combustion, and post-combustion exhaust emission density (especially of nitrogen oxides or $NO_x$) is effectively reduced and improved. As such, the present invention is capable of preventing air pollution and protecting the global environment.

3 Claims, 4 Drawing Sheets

COMBUSTION ENHANCEMENT DEVICE FOR INTERNAL COMBUSTION ENGINES

BACKGROUND OF THE INVENTION

1) Field of the Invention

The invention herein relates to internal combustion engine performance improvement accessories, specifically a combustion enhancement device for internal combustion engines.

2) Description of the Related Art

When air containing oxygen is induced into the carburetor of an internal combustion engine and mixed with fuel (fuel oil) and then ignited in the combustion chamber, the post-combustion exhaust gases are mainly composed of carbon monoxide (CO), hydrocarbons (HC), and nitrogen oxides ($NO_x$) along with lesser amounts of carbon dioxide, sulfur, and lead compounds.

Of the said constituents, carbon monoxide (CO), hydrocarbons (HC), and nitrogen oxides ($NO_x$) are the major representative constituents found in conventional internal combustion exhaust emissions and are also the significant factors that influence the internal combustion efficiency of internal combustion engines, with the specific effect on such combustion efficiency respectively described below.

1. Carbon monoxide (CO): The result of incomplete fuel combustion, when the air and fuel mixture (air-fuel ratio) is proportionally correct, carbon monoxide (CO) density is lower. In other words, when air containing maximum levels of oxygen is supplied, combustibility is raised, enabling the fuel to burn completely and thereby effectively reducing carbon monoxide density. Conversely, when oxygen present in the air is insufficient, more carbon monoxide is produced during the said combustion.

2. Hydrocarbons (HC): This is a substance in the post-combustion residue that accumulates on cylinders and exhaust valves which lowers the cylinder wall temperature and leads to incomplete combustion, with maximum combustion ignition especially affected if the said residual substance is not removed.

3. Nitrogen oxides ($NO_x$): Essentially nitrogen oxide (NO), the continuous amalgamation of such oxide with various other foreign matter (such as dust, floating particles, and lead ions, etc.) during its formation as large volumes of air are admitted causes the uninterrupted build-up of $NO_2$, $NO_3$, $NO_4$, and so on, which are generally termed $NO_x$. In other words, the said resulting $NO_x$ occurs in reaction to combustion at high temperatures of more than 1,000° C. due to rapid intermittent changes in air structure during the high voltage exciting of spark plugs or the high pressure action of the fuel injection nozzles, the resulting breakdown of molecular structure directly producing these oxidized substances. As such, the so-called nitrogen oxides ($NO_x$) form accordingly and the $NO_x$ created not only seriously affect combustion characteristics, but also leads to incomplete combustion and increasingly denser exhaust emissions.

To summarize of the foregoing section, the said carbon monoxide (CO), hydrocarbons (HC), and nitrogen oxides ($NO_x$) are all post-combustion phenomena explainable by physics, with carbon monoxide (CO), hydrocarbons (HC), and nitrogen oxides ($NO_x$) produced in the lowest, medium, and highest respective volumes.

Based on preceding section, since the said carbon monoxide(CO) is produced when the air and fuel mixture is incorrect, this can be improved by adjusting the carburetor or the fuel injection pump. Furthermore, since hydrocarbon (HC) is produced due to the effect of fuel line, fuel injection nozzle, and cylinder wall conditions on fuel carburization and ignition, this situation can be improved by performing maintenance on and adjusting the carburetor and the fuel injection pump. However, since nitrogen oxides ($NO_x$) occurs in reaction to combustion at high temperatures of more than 1,000° C., none of the said solutions, including carburetor and fuel injection pump adjustment and maintenance, are capable of improving nitrogen oxide ($NO_x$) density.

In other words, since nitrogen oxides ($NO_x$), the combustion by-product present in the highest volume, is produced by the intermittent breakdown of the air structure during the high voltage exciting of spark plugs or the high pressure action of the fuel injection nozzles, it is necessary to the understand the structural composition of air, especially how the quality of air before combustion directly influences exhaust gas emission density as well as the physics of air ionization, all of which must be first fully understood.

In the physics of air ionization, as based on research reports about air ionization by scientists around the world, the ionization of the said air occurs because ions in the atmosphere bond with positively charged particles and negatively charged particles (according to a treatise on air ion theory and experimentation by Dr. Kuboda Tetsujiro of Tokyo University published in 1996). Among the constituents of air, oxygen ($O_2$) has the greatest affect on the combustion efficiency of internal combustion engines; in other words, if the negative and positive ions ($O^+$ and $O^-$) of the said oxygen ($O_2$) were perfectly balanced, this would provide for the best combustion efficiency and, conversely, if either of the negative and positive ions ($O^+$ and $O^-$) are present in insufficient or excessive quantities, this would result in incomplete combustion.

Simply stated, since the foreign matter conveyed in the air includes large volumes of the dust, microorganisms, floating particles, and other impurities, with the said foreign matter naturally carrying a large volume of positively charged ions, when the said large volume of the positively charged ions of the various foreign matter is commingled with air and then induced into an internal combustion engine carburetor and combustion chamber, mixed with fuel (fuel oil), and combusted, the said positively charged ions overwhelmingly outnumber the negatively charged ions, resulting in poor combustion efficiency and combustion performance due to incomplete combustion and, furthermore, a higher exhaust emission density.

In other words, when the said foreign matter conveying a large volume of positively charged ions in the form of dust, microorganisms, floating particles, and other impurities is mixed with air and induced into the internal combustion engine, although most internal combustion engines are equipped with air filters, they are only capable of filtering out the larger entities of foreign matter and cannot strain out the microscopic variants and, therefore, a large volume of foreign matter is still admitted into the carburetor through the air filter. Generally speaking, since the metal portion of the said internal combustion engine serves as a negative ground and the surface of the air intake pipe carries a negative charge, when oxygen and the various foreign matter contained in the air enters the internal combustion air intake pipe, the said air intake pipe automatically absorbs some of the positively charged ions in the air, but since the air flow speed of the said air intake pipe is extremely rapid, the complete absorption of the positively charged ions is not possible and, furthermore, the rapid rate of wall friction directly reduces the generation of the negatively charged ions at the air intake pipe as the said large volume of positively charged ions accordingly enter the carburetor and the combustion chamber, leading to low combustion efficiency and a higher exhaust emission density, especially as the quality of the air become worse (as foreign matter increases) and the temperature of the internal combustion engine increases, whereupon the said low combustion efficiency and higher exhaust emission density (referring to the volume of $NO_x$) becomes very noticeable.

The preceding section informs that the high or low combustion efficiency of an internal engine as well as its exhaust emission density is directly and, furthermore, inseparably related to whether the oxygen ($O_2$) in the air that is induced into the carburetor and combustion chamber is in a state of perfect ionic balance (i.e., the volume of $O^+$ and $O^-$ is equal); the oxygen in the air conventionally utilized by internal combustion engines at present, as described above, has extremely large volumes of positively charged ions and given the proportionate insufficiency of negatively charged ions, they exhibit low combustion efficiency and high exhaust emission density, the said low combustion efficiency and high exhaust emission density resulting in the drawbacks of greater fuel consumption and non-compliance with environmental protection policies. In other words, how to increase the positively charged ion count of oxygen contain in air during combustion and thereby enhance combustion by achieving a near perfect balance of oxygen ($O^2$) positive ions ($O^+$) and negative ions ($O^-$) has become the major method of raising the combustion efficiency and reducing the exhaust emission density of internal combustion engines.

SUMMARY OF THE INVENTION

The primary objective of the invention herein is to provide a combustion enhancement device for internal combustion engines installed in front of the carburetor (or fuel injection pump) comprised of a tourmaline crystal or mildly radioactive tritium isotope mineral elements. The tourmaline is directly utilized for the operation of a negatively charged ion generator that provides large volumes of negatively charged ions such that when air containing oxygen induced into the carburetor as well as the combustion chamber is thereby combustion-enhanced, a large volume of negatively charged ions is mixed with the large volume of positively charged particles naturally present in the air, enhancing combustion by purifying the oxygen ($O_2$) required. As such, the power creating combustion of an internal combustion engine not only occurs at greater efficiency, but fuel is also combusted more completely, energy is saved because less fuel is required for combustion, and post-combustion exhaust emission density is effectively reduced and improved. As such, the present invention is capable of preventing air pollution and protecting the global environment.

Another objective of the invention herein is to provide a combustion enhancement device for internal combustion engines that is simple in structure, easy and convenient to install and utilize as well as capable of optimizing the combustion efficiency of internal combustion engines, lowering the fuel consumption of internal combustion engines, and reducing and improving the post-combustion exhaust emission density of internal combustion engines to thereby achieve the objectives of preventing air pollution and protecting the global environment and, furthermore, the present invention provides a combustion enhancement device for internal combustion engines that is practical, ideal, progressive and, furthermore, original.

DETAILED DESCRIPTION OF THE INVENTION

Figure 1:
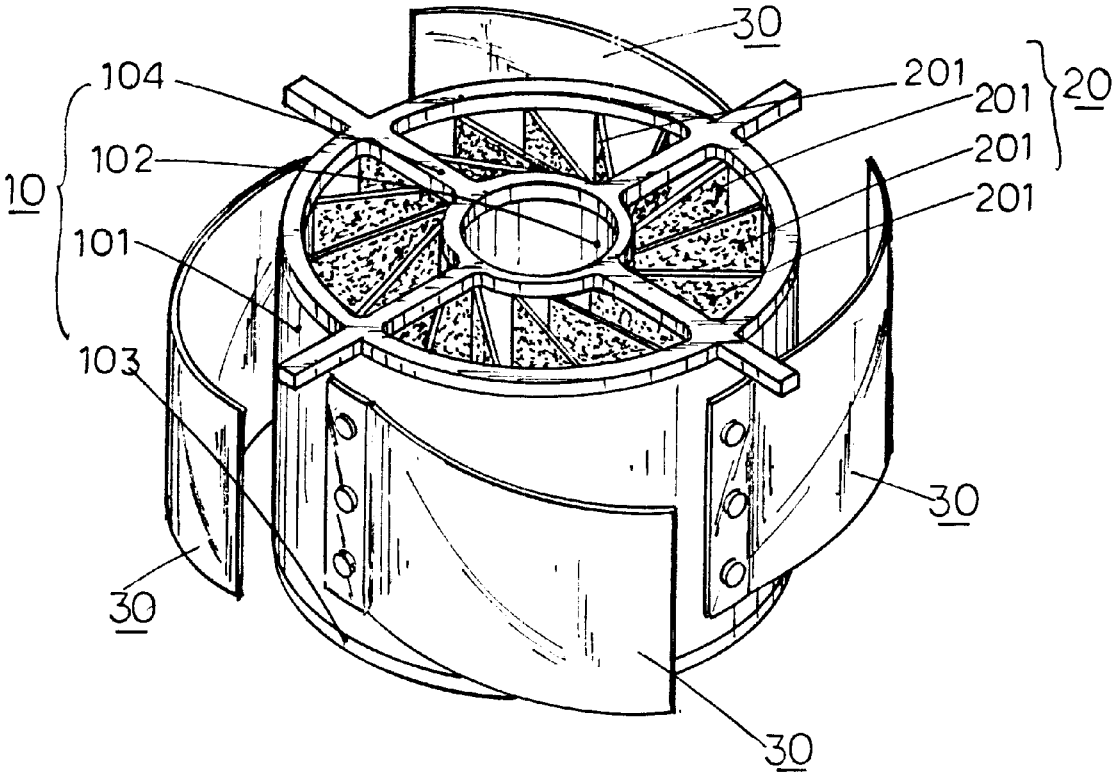
FIG. 1 an isometric drawing of the invention herein.
Figure 2:
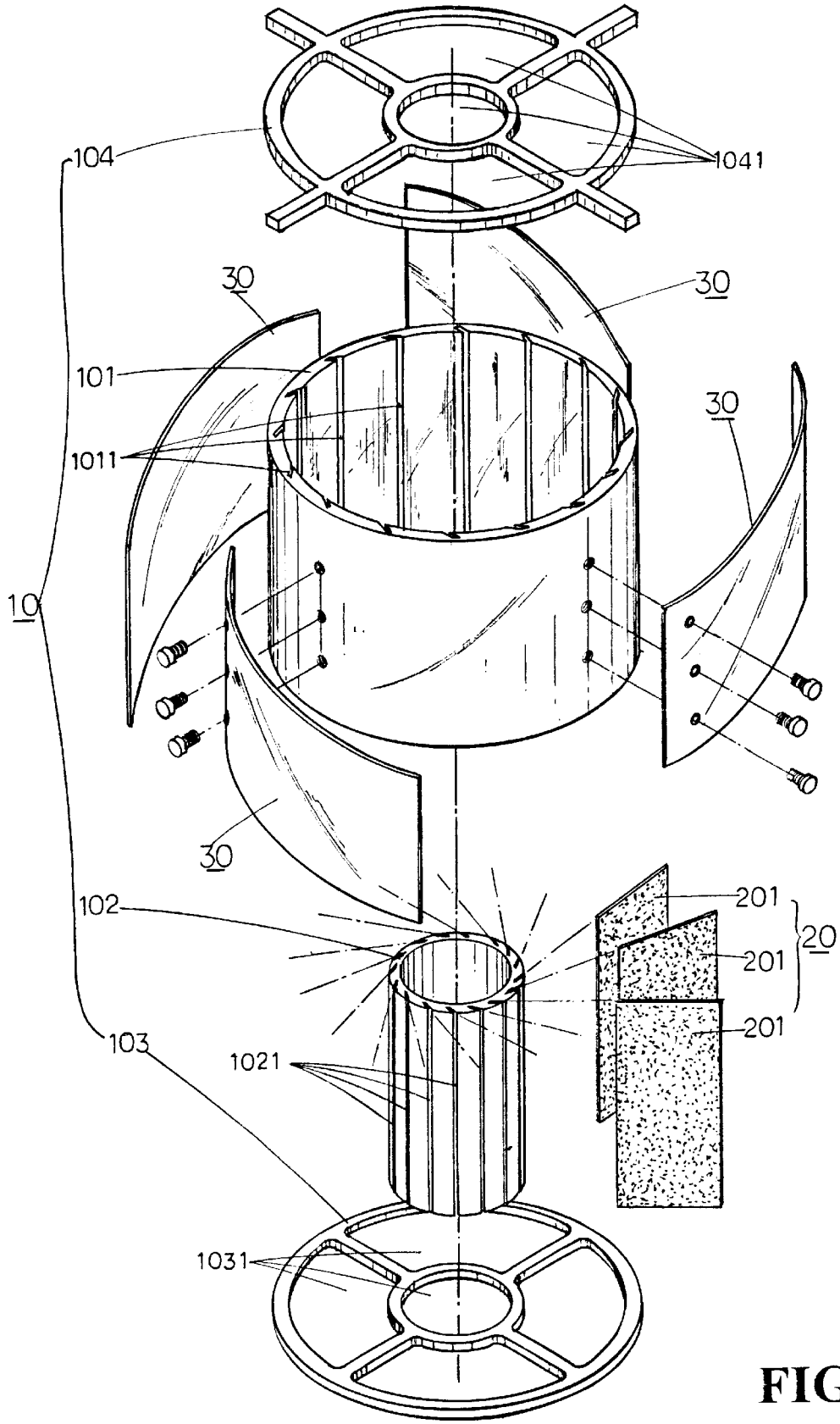
FIG. 2 an exploded drawing of the invention herein.
Figure 4:
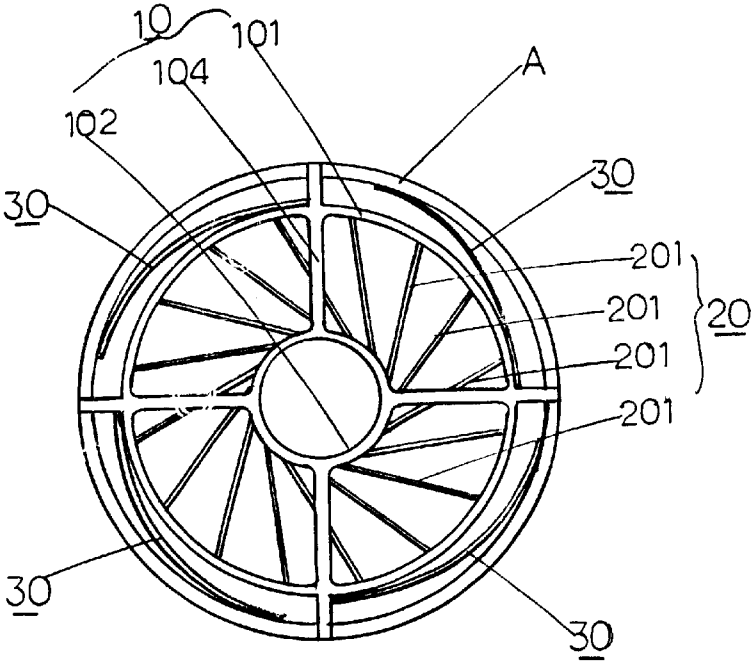
FIG. 4 an orthographic drawing of the invention herein, as viewed from the top.
Figure 3:
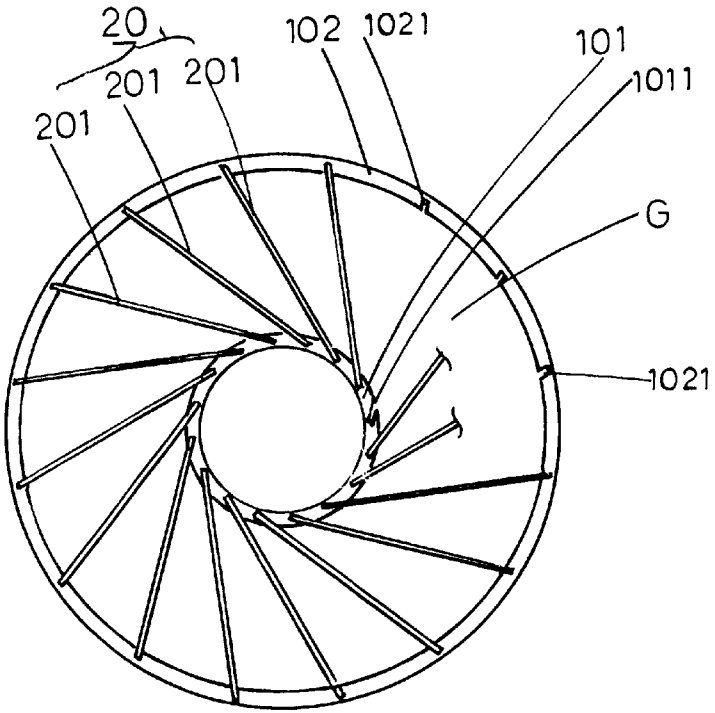
FIG. 3 an orthographic drawing of the inner and outer sleeves and the negatively charged ion generator arrangement of the invention herein.
Figure 5:
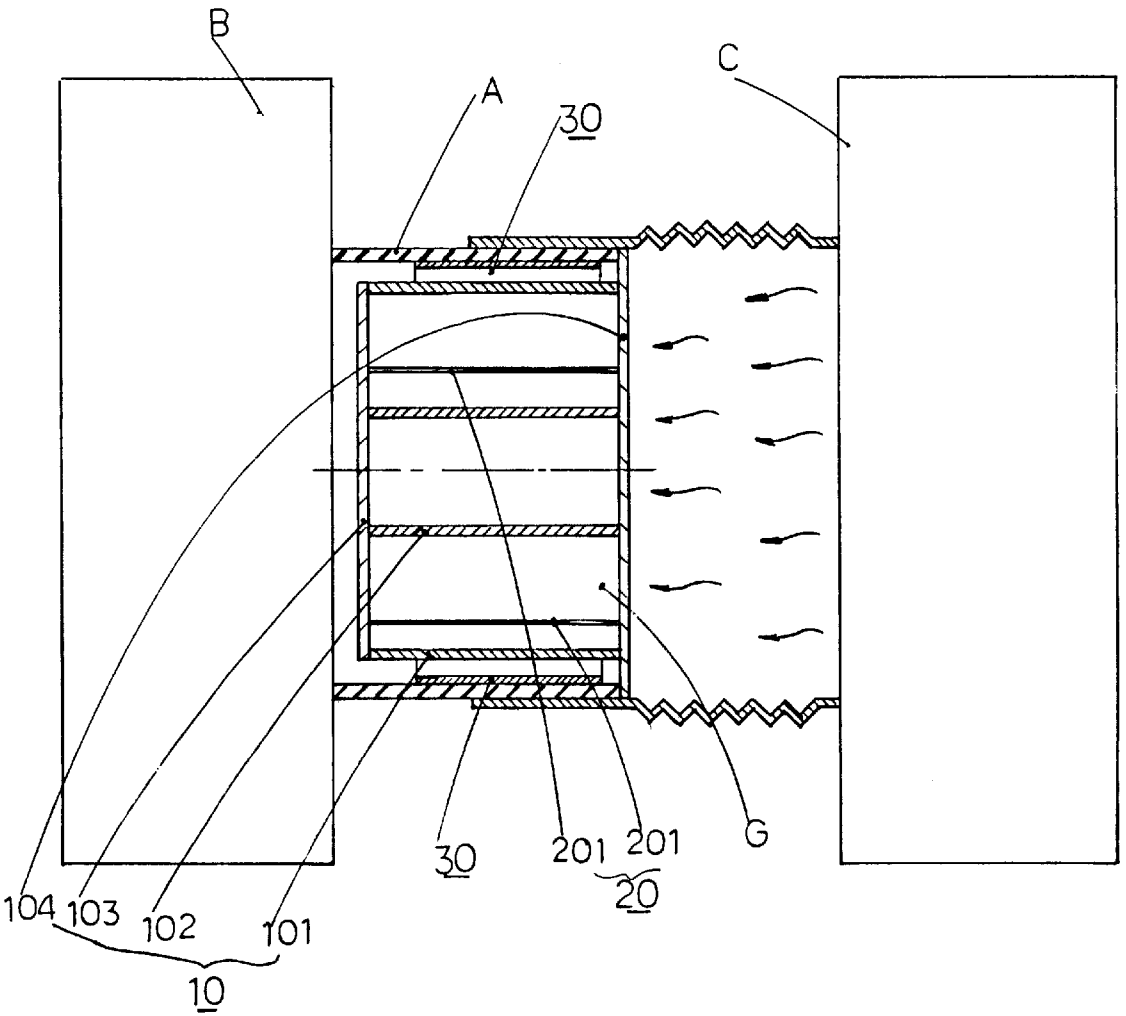
FIG. 5 is an orthographic drawing of the invention herein installed on the air intake pipe of an internal combustion engine.

Referring to FIG. 1, FIG. 2, FIG. 3, and FIG. 4, the combustion enhancement device for internal combustion engines of the invention herein is comprised of a mounting fixture 10, a negatively charged ion generator 20, and positioning springs 30, in which:

The said mounting fixture 10 provides for the placement of the negatively charged ion generator 20 and installation into the air intake pipe A (see FIG. 5) of an internal combustion engine, with the embodiment of the invention herein consisting of an outer sleeve 101, an inner sleeve 102, a bottom cover 103, and a top cover 104, wherein the said inner sleeve 102 is centered inside the outer sleeve 101 such that the intermediary space between them serves as an air passage G (see FIG. 3), a plurality of retaining slots 1021 and 1011 respectively arrayed along the exterior surface of the inner sleeve 102 and the interior surface of the outer sleeve 101, and a plurality of openings 1031 and 1041 respectfully cut in a geometric arrangement through the said bottom cover 103 and the top cover 104; during assembly, the said inner and outer sleeves 102 and 101 are concentrically positioned by clamps or jig and the bottom cover 103 is conjoined to one end (in the embodiment herein, conjoinment is achieved by spot welding), the negatively charged ion generator 20 is then placed into the air passage G, and the said top cover 104 is conjoined to the opposite end in a similar manner (as shown in FIG. 4).

The said negatively charged ion generator 20 is materially constructed of a lightweight, thin aluminum plate that is coated with an alkene-series substance, granulated mineral, and ceramic finishing solution to fabricate negatively charged ion elements 201; the said mineral utilized is tourmaline or mildly radioactive tritium isotope such that air passing over one negatively charged ion element 201 (10 $cm^2$) produces approximately 5,000 negatively charged ions/$cm^3$; the negatively charged ion generator 20 embodiment of the invention herein consists of a plurality of negatively charged ion elements 201 of a certain dimension and surface area, and following the direct insertion of the said negatively charged ion elements 201 into the retaining slots 1021 and 1011 of the mounting fixture 10 inner and outer sleeves 102 and 101 and the conjoinment of the top cover 104, they are thereby stably secured into position; as such, when air passes through the air passage G between the mounting fixture 10 inner and outer sleeves 102 and 101, the negatively charged ion elements 201 of the said negatively charged ion generator 20 produces a large volume of the negatively charged ions such that the volumetric quantity of negatively charged ions contained in the said air is directly and, furthermore, definitely increased. The said negatively charged ion elements 201 can be coated with the tourmaline or tritium isotope finish on one side or can be fabricated by applying the said finish on two sides.

The said positioning springs 30 maintains the mounting fixture 10 within the air intake pipe A of the internal combustion engine and facilitates installation and stability and, furthermore, in the embodiment of the invention herein consists of a plurality of flat springs 30 fastened to the exterior surface of the mounting fixture 10 outer sleeve 101.

To utilize the invention herein described above, referring to the FIG. 5, the combustion enhancement device for internal combustion engines of the present invention is installed in the air intake pipe A anterior to the carburetor B, and optimally installed behind the air filter C; since the said mounting fixture 10 is directly placed into the front end of the internal combustion engine air intake pipe A and constrained in place by the tensile pressure of the positioning springs 30, the installation of the invention herein is simple and convenient and, furthermore, does not affect the structural components of the internal combustion engine and is completely safe.

When air containing oxygen and large volumes of foreign matter (such as dust and other floating particles) carrying positively charged ions passes through the air filter C into the air intake pipe A and the invention herein installed in the said air intake pipe A, wherein the plurality of negatively charged ion elements 201 of the negatively charged ion generator 20 are situated in the mounting fixture 10 air passage G, the said air flowing through the air passage G is mixed with a large volume of negatively charged ions produced by the said negatively charged ion generator 20 and admitted into the combustion chamber via the carburetor B; the said large volume of negatively charged ions become completely mixed with the said large volume of positively charged ions in air such that the negatively charge ion deficiency of the original air is supplemented and purified by oxygen ($O_2$), thereby optimizing combustion by assisting the fuel combustion process in the combustion chamber to provide for greater combustion efficiency, complete combustion, and reducing the density of post-combustion exhaust emissions; the higher efficiency of the combustion process in the said internal combustion engine and the lowered exhaust emission content also increases internal combustion working efficiency (i.e., more horsepower), saves fuel, and effectively improves air pollution, thereby providing for more economic performance and environmental protection compliance.

In summation of the foregoing section, since the internal combustion engine combustion enhancement device of the invention herein provides the actual solutions required to overcome performance problems of conventional internal combustion engines and its installation and structure are not complex or difficult, and the overall operating concept is feasible and, furthermore, a similar product has not been observed in use, the present invention meets the new patent application requirements of originality, progressiveness, and industrial utility and is submitted to the examination committee for review and the granting of the commensurate patent rights.

However, the said disclosure is only introduces the most preferred embodiment of the invention herein and all modifications and embellishments (such as respectively arraying the plurality of retaining slots that provide for the placement of the negatively charged ion elements in the bottom cover and top cover of the mounting fixture; or, utilizing another type of elastic component instead of the positioning springs to enable the convenient and stable installation into the air intake pipe of the internal combustion engine, etc.) based on the disclosed technical means shall remain within the protected scope and claims of the invention herein.

What is claimed is:

1. A combustion enhancement device for internal combustion engines in which a negatively charged ion generator capable of producing negatively charged ions is installed in front of the carburetor (or fuel injection pump) of an internal combustion engine, with the said negatively charged ion generator consisting of a plurality of thin plate-like negatively charged ion elements that are situated on a mounting fixture, with the said mounting fixture installed in the air intake tube of the internal combustion engine and maintained in place by positioning springs.

2. As mentioned in claim 1 of the combustion enhancement device for internal combustion engines of the invention herein, the said mounting fixture has an air passage that provides for the installation of said negatively charged ion elements of the said negatively charged ion generator at appropriate intervals apart.

3. As mentioned in claim 1 and claim 2 of the combustion enhancement device for internal combustion engines of the invention herein, said negatively charged ion elements of the said negatively charged ion generator utilizes a mineral such as tourmaline or mildly radioactive tritium isotope as their active ingredients.

* * * * *